US009056497B2

(12) United States Patent
Sugiura

(10) Patent No.: US 9,056,497 B2
(45) Date of Patent: Jun. 16, 2015

(54) PRINTING CONTROL APPARATUS AND PRINTING CONTROL METHOD FOR INTERRUPTION PRINTING

(75) Inventor: Satoshi Sugiura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 13/052,413

(22) Filed: Mar. 21, 2011

(65) Prior Publication Data

US 2011/0236107 A1 Sep. 29, 2011

(30) Foreign Application Priority Data

Mar. 24, 2010 (JP) ..... 2010-068288

(51) Int. Cl.
*B41J 29/38* (2006.01)
*B41J 13/00* (2006.01)
*B41J 3/60* (2006.01)

(52) U.S. Cl.
CPC ..... *B41J 13/0045* (2013.01); *B41J 29/38* (2013.01); *B41J 3/60* (2013.01)

(58) Field of Classification Search
CPC ..... B41J 13/0045; B41J 3/60
USPC ..... 399/87, 384, 401; 400/614, 76, 188
See application file for complete search history.

(56) References Cited

U.S. PATENT DOCUMENTS 4,641,954 A * 2/1987 Miyata et al. ..... 399/87
5,987,300 A * 11/1999 Mori ..... 399/401
2009/0225364 A1* 9/2009 Sato ..... 358/1.15
2011/0211892 A1 9/2011 Yasuzaki
2011/0236105 A1 9/2011 Noguchi

FOREIGN PATENT DOCUMENTS

JP 10-339975 A 12/1998
JP 11-249346 A 9/1999
JP 11249346 A * 9/1999 ..... G03G 15/00
JP 2000-321827 A 11/2000
JP 2000-353068 A 12/2000
JP 2004-254047 A 9/2004
JP 2005-073036 A 3/2005
JP 2005208124 A * 8/2005 ..... G03G 21/00
JP 2006-321167 A 11/2006
JP 2008-177817 A 7/2008

* cited by examiner

*Primary Examiner* — Daniel J Colilla
*Assistant Examiner* — Justin Olamit
(74) *Attorney, Agent, or Firm* — Canon USA, Inc., IP Division

(57) ABSTRACT

To execute printing on a continuous sheet by using a printing unit, a printing control apparatus includes a reversal unit, an input unit, and a printing control unit. The reversal unit reverses the continuous sheet to execute printing on a second surface of the continuous sheet after executing printing on a first surface of the continuous sheet. The input unit inputs an instruction for executing an interruption print job while executing printing by the printing unit. If instruction for executing the interruption print job is input while the printing of a two-sided print job on the continuous sheet has been currently executed, the printing control unit suspends the two-sided print job, causes the printing unit to execute the interruption print job, and resumes processing of the two-sided print job on the continuous sheet that has been held by the reversal unit after the interruption print job is completed.

18 Claims, 4 Drawing Sheets

PRINTING CONTROL APPARATUS AND PRINTING CONTROL METHOD FOR INTERRUPTION PRINTING

BACKGROUND OF THE INVENTION

1. Field of the Invention

The present invention relates to a printing control apparatus and a printing control method configured to execute printing on a continuous sheet.

2. Description of the Related Art

In printing an image on both surfaces of a continuous sheet, such as a roll sheet, a conventional method, as discussed in Japanese Patent Application Laid-Open No. 11-249346, executes printing on one surface of a continuous sheet that has been conveyed into a printing unit, cuts the continuous sheet, and temporarily winds the cut continuous sheet up. The conventional method then conveys the continuous sheet again into the printing unit to execute printing on the other surface.

In order to execute efficient printing, the printing apparatus like this serially executes printing on one surface of the sheet for a plurality of pages and goes on to printing on the other surface after completing printing of all the pages on one surface. By executing printing on both surfaces of a sheet with such a process, efficient two-sided printing can be executed.

However, in executing two-sided printing in the above-described manner, because printing on the same sheet surface is continuously executed, a preceding two-sided print job cannot be appropriately completed if another print job is input as an interruption print job during printing the two-sided print job. More specifically, if an interruption print job is to be executed during printing on a first surface of a two-sided print job, a sheet used in the preceding print job may be discharged before printing on its second surface is executed.

SUMMARY OF THE INVENTION

The present invention is directed to a printing control apparatus and a printing control method capable, when a preceding two-sided print job for printing on a continuous sheet is currently executed, of inputting another print job as an interruption print job while appropriately completing the preceding two-sided print job.

According to an aspect of the present invention, a printing control apparatus may execute printing on a continuous sheet by using a printing unit. The printing control apparatus includes a reversal unit, an input unit, and a printing control unit. In executing printing by the printing unit on both surfaces of the continuous sheet, the reversal unit reverses the continuous sheet to execute printing on a second surface of the continuous sheet after executing printing on a first surface of the continuous sheet. The input unit inputs an instruction for executing an interruption print job while executing printing by the printing unit. If printing of a two-sided print job on the continuous sheet has been currently executed by the printing unit in a case where the instruction for executing the interruption print job is input by the input unit, the printing control unit suspends the two-sided print job in a state where the continuous sheet used in the two-sided print job is held by the reversal unit. The printing control unit also causes the printing unit to execute the interruption print job according to the instruction for executing the interruption print job input by the input unit. The printing control unit additionally resumes processing of the two-sided print job on the continuous sheet that has been held by the reversal unit after the interruption print job is completed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

DESCRIPTION OF THE EMBODIMENTS

Various exemplary embodiments, features, and aspects of the invention will be described in detail below with reference to the drawings. The relative arrangement of components of an apparatus and a shape of the apparatus according to an exemplary embodiment are mere examples and the present invention is not limited to those described below.

Figure 1:
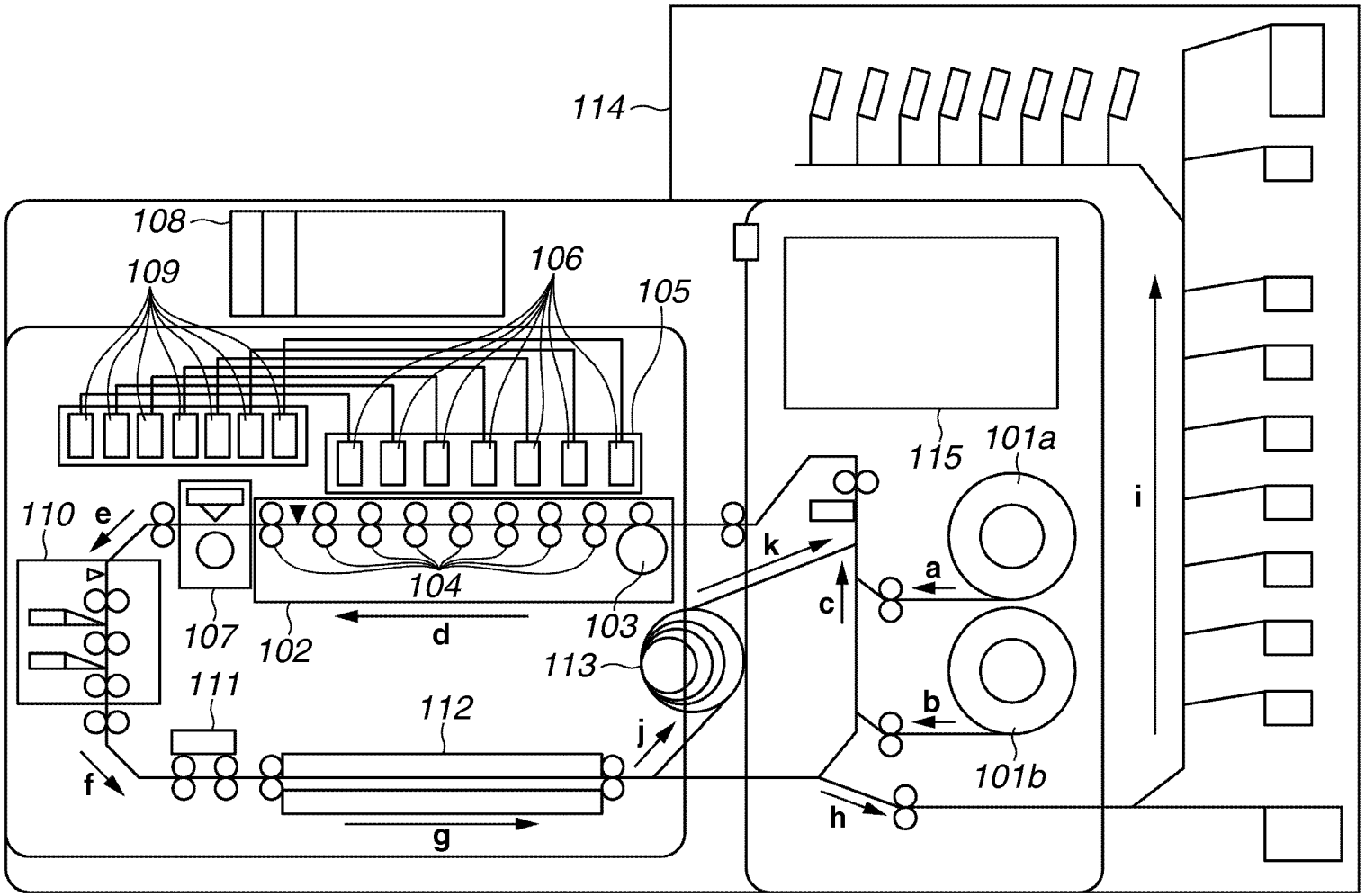
FIG. 1 illustrates an exemplary configuration of an image forming apparatus according to an exemplary embodiment.

FIG. 1 illustrates an exemplary configuration of an image forming apparatus, which is an example of a printing control apparatus according to an exemplary embodiment. The image forming apparatus illustrated in FIG. 1 includes a printing function only, which is a function for printing data received from an external apparatus. However, the present invention is not limited to this. More specifically, an apparatus including a reading unit for reading an image of a document in addition to the printing function and functioning as a copying machine can implement the image forming apparatus according to an exemplary embodiment. Furthermore, a multifunction peripheral (MFP) having other functions in addition to those described above can implement the image forming apparatus according to an exemplary embodiment.

Moreover, in the following description, it is supposed that a roll sheet is used as a recording material (a recording medium or a recording sheet) used for printing. The roll sheet is used as an example of a continuous sheet. However, the present invention is not limited to this. More specifically, a long continuous sheet, even if it is not a roll sheet, can be used if printing of a job including a plurality of pages can be executed on the same surface of the sheet without cutting the sheet.

For a method of cutting the continuous sheet, the image forming apparatus can automatically cut the continuous sheet. Alternatively, the continuous sheet can be cut according to a user instruction for cutting the sheet, which is manually input by the user. The material of the recording sheet is not limited to paper. More specifically, various types of recording materials can be used if an image can be printed thereon.

Furthermore, the present invention is not limited to the image forming apparatus capable of executing printing on a continuous sheet. More specifically, an image forming apparatus capable of printing on a cut sheet, which is provided by previously cutting a continuous sheet into a cut sheet of a predetermined size, can implement an embodiment.

For the printing method, the present invention is not limited to inkjet type printing of an image that uses an image-printing liquid ink, which will be described in detail below. In other words, a solid ink can be used as a recording agent to be applied onto the recording material. Furthermore, the printing method according to an exemplary embodiment can be implemented by various methods, such as an electrophotographic printing method using a toner, a sublimation printing method, a thermal transfer printing method, or a dot impact printing method.

In addition, the present invention is not limited to color recording that uses a plurality of colors of recording agents. To paraphrase this, an embodiment can be implemented by monochromatic recording that uses a black (or gray) recording agent only.

Furthermore, printing according to an exemplary embodiment is not limited to printing of a visible image. In other words, the printing can include printing of an invisible image or an image that cannot be easily visualized. Furthermore, the printing can be implemented by printing of various printable data or patterns different from a general image, such as a pattern of wiring, a physical pattern used to manufacture a part, or a base sequence of deoxyribonucleic acid (DNA). In other words, an embodiment can be implemented by various types of recording apparatuses capable of executing printing that uses a recording material to which a recording agent can be applied.

In addition, in controlling a printing operation on the image forming apparatus according to an instruction input by an external apparatus connected to the image forming apparatus illustrated in FIG. 1, the external apparatus implements the printing control apparatus.

FIG. 1 is a cross section of the entire image forming apparatus that uses a roll sheet (i.e., a continuous sheet which is continuous and having a length longer than a unit of printing (the length of a page) in the conveyance direction) as a recording material. The image forming apparatus includes the following components 101 through 115, which are provided within one integrated housing. However, alternatively, the components 101 through 115 of the image forming apparatus can be provided separately from one another in a plurality of housings.

A control unit 108 includes a control section having a controller (including a central processing unit (CPU) or a micro processing unit (MPU)), an output device for outputting user interface (UI) information (i.e., a display information generation device or an audio information generation device), and various input/output (I/O) interfaces. The control unit 108 executes various control operations on the entire image forming apparatus.

In addition, the image forming apparatus includes two roll sheet storage and feeding units, such as an upper-stage sheet cassette 101*a* and a lower-stage sheet cassette 101*b*. A user of the image forming apparatus sets the roll sheet (hereinafter simply referred to as a "sheet") into a magazine and then sets the magazine onto the image forming apparatus body.

A sheet fed from the upper-stage sheet cassette 101*a* is conveyed in a direction "a" illustrated in FIG. 1. On the other hand, a sheet fed from the lower-stage sheet cassette 101*b* is conveyed in a direction "b" illustrated in FIG. 1. The sheet fed from the upper-stage sheet cassette 101*a* or the lower-stage sheet cassette 101*b* is then conveyed in a direction "c" to reach a conveyance unit 102. During printing, the conveyance unit 102 conveys the sheet in a direction "d" (i.e., in the horizontal direction) via a plurality of rollers 104.

The sheet feeding source can be changed from one sheet cassette to the other by winding the already fed part of the roll sheet back into the cassette and by supplying a new sheet from the cassette in which the sheet to be newly fed has been set.

In addition, the image forming apparatus includes a head unit 105, which is provided above and facing the conveyance unit 102. The head unit 105 includes a plurality of printing heads 106 of a plurality of colors (in an exemplary embodiment, seven colors), which are provided independent from one another. More specifically, the printing heads 106 are supported within the head unit 105 along the sheet conveyance direction. In an exemplary embodiment, seven printing heads 106 are used corresponding to seven colors including cyan (C), magenta (M), yellow (Y), light cyan (LC), light magenta (LM), gray (G), and black (K). However, a printing head corresponding to a color other than those described above can be used as the printing head 106. Furthermore, it is not necessary to use all the seven color printing heads 106 to implement an embodiment.

In synchronization with the conveyance of the sheet by the conveyance unit 102, the image forming apparatus of the present exemplary embodiment causes the printing head 106 to discharge an ink therefrom to form an image on the sheet. The printing head 106 is provided at a location at which an ink discharge target position does not come to the position of the rollers 104.

Instead of forming an image by discharging the ink directly onto the sheet, an image can also be formed by applying the ink onto a surface of an intermediate transfer member and then transferring the ink onto the sheet from the intermediate transfer member. A printing unit according to an exemplary embodiment includes the conveyance unit 102, the head unit 105, and the printing head 106.

Ink tanks 109 respectively store corresponding color inks independently from one another. The ink is supplied from the ink tank 109 into a sub tank, which is provided corresponding to each color ink, via an ink supply tube. The ink is then supplied from the sub tank to each of the printing heads 106 via another ink supply tube.

A plurality of line heads for each corresponding color (each of the seven colors used in an exemplary embodiment) is arranged in the sheet conveyance direction "d", along which the sheet is conveyed during printing. A line head including an integrated seamless nozzle chip can be used for the line head corresponding to each color. Alternatively, a line head including divided nozzle chips regularly arranged in a straight-line configuration or in a staggered configuration can be used for the line head corresponding to each color. In an exemplary embodiment, a "full multihead" is used, having a plurality of nozzles arranged within a range substantially equivalent to or greater than an width of a printable region of a sheet of a largest size that can be used for printing by the image forming apparatus according to an exemplary embodiment.

For the inkjet type printing method of the present exemplary embodiment, a printing method that uses a heat generation device, a printing method that uses a piezoelectric element, a printing method that uses an electrostatic element, or a printing method that uses a micro electro mechanical systems (MEMS) element can be used.

The ink is discharged from the nozzles of each head according to input print data at an ink discharge timing determined according to an output signal from a conveyance encoder 103. After the image is formed on the sheet, the sheet is conveyed from the conveyance unit 102 to a scanner unit 107.

The scanner unit 107 optically reads the image or a special pattern printed on the sheet and verifies whether the quality of the printed image is sufficiently high and verifies the status of operation of the image forming apparatus including an ink discharge status. The quality of the printed image can be verified based on a result of verifying the ink discharge status, which can be determined according to a result of reading a pattern used for verifying the status of the head. Alternatively, the quality of the printed image can be verified based on a result of printing, which can be verified according to a result of comparison of the printed image with an original image. Various methods can be appropriately and selectively determined and used for verifying the quality of the printed image.

The sheet is conveyed from around the scanner unit 107 in a direction "e" and is guided into a cutter unit 110. The cutter unit 110 cuts the sheet in the unit of a length equivalent to a predetermined unit of printing. The predetermined unit of printing may differ according to the size of an image to be printed.

For example, if an L-size photograph is to be printed, the length of the sheet in the conveyance direction is 135 mm. If an A4-size sheet is used, the length of the sheet in the sheet conveyance direction is 297 mm. In executing one-sided printing, the cutter unit 110 cuts the sheet in units of pages. However, the cutter unit 110 may cut the sheet not in units of pages according to the content of an input print job.

On the other hand, in executing two-sided printing, the cutter unit 110 cuts, after images on a first surface of the sheet (i.e., a front surface of the sheet) up to a predetermined sheet length are printed without cutting the sheet in units of pages and then an image on a second surface of the sheet (i.e., a back surface of the sheet) is printed, the sheet in unit of a page.

In executing one-sided printing or in printing on the back surface of the sheet in two-sided printing, the cutter unit 110 can cut the sheet by a cutting method other than cutting the sheet in the unit of one printed image. More specifically, the cutter unit 110 can cut the sheet after the sheet is conveyed by a predetermined sheet length. In this case, another cutting apparatus can be used to allow the user to cut the sheet in the unit of one image (one page image) by a manual operation. If it is necessary to cut the sheet in the sheet width (latitudinal) direction, another cutting apparatus can be used to execute the cutting of the sheet in this direction.

The sheet conveyed from the cutter unit 110 is conveyed within the printing unit in a direction "f" to reach a back-surface printing unit 111. In printing an image only on one surface of the sheet, the back-surface printing unit 111 prints predetermined information on the back surface of the sheet. Information to be printed on the back surface of the sheet includes various types of information, such as a character, a symbol, or codes corresponding to each image printed on the front surface of the sheet (e.g., an order management number).

If the printing head 106 prints an image of a two-sided print job, the back-surface printing unit 111 prints the above-described information outside an area in which an image is formed by the printing head 106. For the back-surface printing unit 111, a recording agent impression type printing unit, a thermal transfer type printing unit, or an inkjet type printing unit can be used.

After being conveyed through the back-surface printing unit 111, the sheet is further conveyed to a drying unit 112. The drying unit 112 applies heat onto the sheet, which is conveyed through the drying unit 112 in a direction "g" illustrated in FIG. 1, with warm air (warmed gas (air)) to dry up the sheet to which the ink has been applied within short seconds. To dry up the sheet having the image printed thereon, various methods can be used. In other words, the sheet can be dried by blowing cold air thereon, by applying heat by using a heater (not illustrated), by natural drying, i.e., by merely stopping the sheet within the drying unit 112, or by irradiating the sheet with an electromagnetic wave, such as ultraviolet (UV) light.

After being cut in the unit of printing, the sheet is conveyed from the drying unit 112 one by one to be further conveyed in a direction "h" into a sorting unit 114. The sorting unit 114 stores a plurality of trays (in the present exemplary embodiment, eighteen trays). The sorting unit 114 selectively uses a tray onto which the sheet is to be discharged according to the length of the unit of printing. Each tray is assigned with a unique tray number.

While detecting the status of the sheet being conveyed through the sorting unit 114 in a direction "i" and verifying the availability of the tray (i.e., whether the tray has been full of printed and cut sheets stacked thereon) by using a sensor provided on each tray, the sorting unit 114 discharges the sheet onto the tray corresponding to the tray number set for each printed image. The tray that is a cut sheet discharge destination can be determined by designating a specific tray on a print job input source apparatus (host apparatus). Alternatively, the image forming apparatus can arbitrarily designate an available tray as the tray onto which the cut sheet is to be discharged.

One tray can stack a predetermined number of cut printed sheets. If the number of prints to be printed by executing a print job exceeds the predetermined number, the sheets are to be selectively discharged on a plurality of trays. The number, the size, and the type of sheets that can be discharged on one tray differ according to the size (type) of the tray.

In the example illustrated in FIG. 1, both large-size sheets (i.e., sheets larger than L-size sheets, such as A4-size sheets) and small-size sheets (i.e., L-size sheets) can be discharged onto the trays vertically provided in tandem to one another (hereinafter simply referred to as "large tray(s)"). In addition, onto the trays provided from left to right in the drawing (i.e., the trays provided horizontally in tandem to one another) (hereinafter simply referred to as "small tray (s)"), a small-size sheets (L-size sheets) can be discharged but large-size sheets cannot be discharged. More sheets can be output onto the large tray than onto the small tray.

Furthermore, an exemplary embodiment uses a display device, such as a light-emitting diode (LED), to allow the user to recognize the operation status, such as "sheet being discharged . . . " or "sheet discharge completed". More specifically, a plurality of LEDs, which emits light in mutually different colors, can be provided to the trays to notify the user of various status information about the sheet stacking state of each tray. In this case, the color of the lit LED can indicate a corresponding status. Alternatively, whether the LED is lit or flashing can notify the user of the sheet stacking state of each tray.

A sheet discharge stacking order can be assigned to each of the plurality of trays. In executing a print job, the image forming apparatus serially designates available trays (trays stacking no sheets) as sheet discharge destinations according to the sheet stacking priority order. As a default setting, the large trays have a descending sheet stacking priority order from top to bottom. The small trays have a left-to-right descending sheet stacking priority order. The large trays have a higher sheet stacking priority order than the small trays.

The sheet stacking priority order of the tray located where the user can easily take out the sheet stacked thereon can be previously set high. Furthermore, the sheet stacking priority order can be appropriately changed by a user operation.

The sheet winding unit 113 rotates to wind up the sheet that has not been cut in units of pages and having an image printed on its front surface. In executing two-sided printing, the cutter unit 110 at first does not cut the printed sheet having an image printed thereon in units of pages until the continuously executed printing of the front surface is completed.

After the image is printed on the front surface of the sheet, the sheet is conveyed through the printing unit in a direction "j" illustrated in FIG. 1 to be wound up by the sheet winding unit 113. After a series of printing of the image on the front surface of the sheet is completed and the sheet having the image on the front surface thereof is wound up by the sheet winding unit 113, the sheet is conveyed again through the printing unit in a direction "k" to enable printing on the other surface of the front surface (i.e., in a state in which the surface to face the printing heads 106 is reversed). By conveying the sheet in the above-described manner, an image can be printed on the back surface of the sheet (the other side of the front surface).

In executing normal one-sided printing, the sheet having an image printed thereon is directly conveyed to the sorting unit 114 without being wound up by the sheet winding unit 113. As described above, in executing two-sided printing, the sheet winding unit 113 winds up the sheet and the sheet is reversed to print an image on the back surface of the sheet. Accordingly, the surface that may face upwards when discharged into the sorting unit 114 in executing one-sided printing differs from that in the case of two-sided printing.

In other words, in executing one-sided printing, because the sheet is not reversed by the sheet winding unit 113 in this case, the sheet having an image of a first page printed thereon is discharged in a state in which the surface of the sheet having the first page image printed thereon faces downwards.

In executing a print job including a plurality of pages, the sheets are serially discharged on the tray starting from the sheet having the first page image printed thereon to sheets corresponding to subsequent pages. In this manner, the sheets are stacked on the tray. The method for discharging the sheets in the above-described manner is referred to as "face-down discharge".

On the other hand, in executing two-sided printing, because the sheet is reversed by the sheet winding unit 113, the sheet having the image of the first page printed thereon is discharged in a state in which the first page image faces upwards. In this case, if a print job that requires the output of a plurality of sheets has been input and executed, the sheets are to be discharged onto the tray starting from the sheet having an image of the last page thereof. Subsequently, subsequent sheets are serially discharged on the sheet in ascending order of the page number. In this manner, the sheets are stacked on the tray in this case to finally discharge the sheet having the image of the first page printed thereon onto the tray. The method for discharging the sheets in the above-described manner is referred to as "face-up discharge".

Alternatively, if it is desired to discharge the sheet on the same surface regardless of one-sided or two-sided printing (i.e., if it is desired to always discharge the sheet by the face-up discharge or the face-down discharge), the order of printing the first surface (in the descending order or the ascending order) can be changed according to the printing method (one-sided printing or two-sided printing).

The user can input various operations via an operation unit 115. In addition, various types of information can be notified to the user via the operation unit 115. More specifically, the user can verify onto which tray the sheet having the image designated by the user and printed thereon has been stacked by referring to the information displayed on the operation unit 115. Furthermore, the user can also verify the status of progress of printing of each order, i.e., whether the printing of the image designated by the user has already been completed or not.

In addition, the user can operate the operation unit 115 to verify various status information about the image forming apparatus, such as the remaining ink amount or the remaining quantity of the sheets. Furthermore, the user can also operate the operation unit 115 to input an instruction for executing a maintenance operation of the image forming apparatus, such as cleaning of the printing head.

Figure 2:
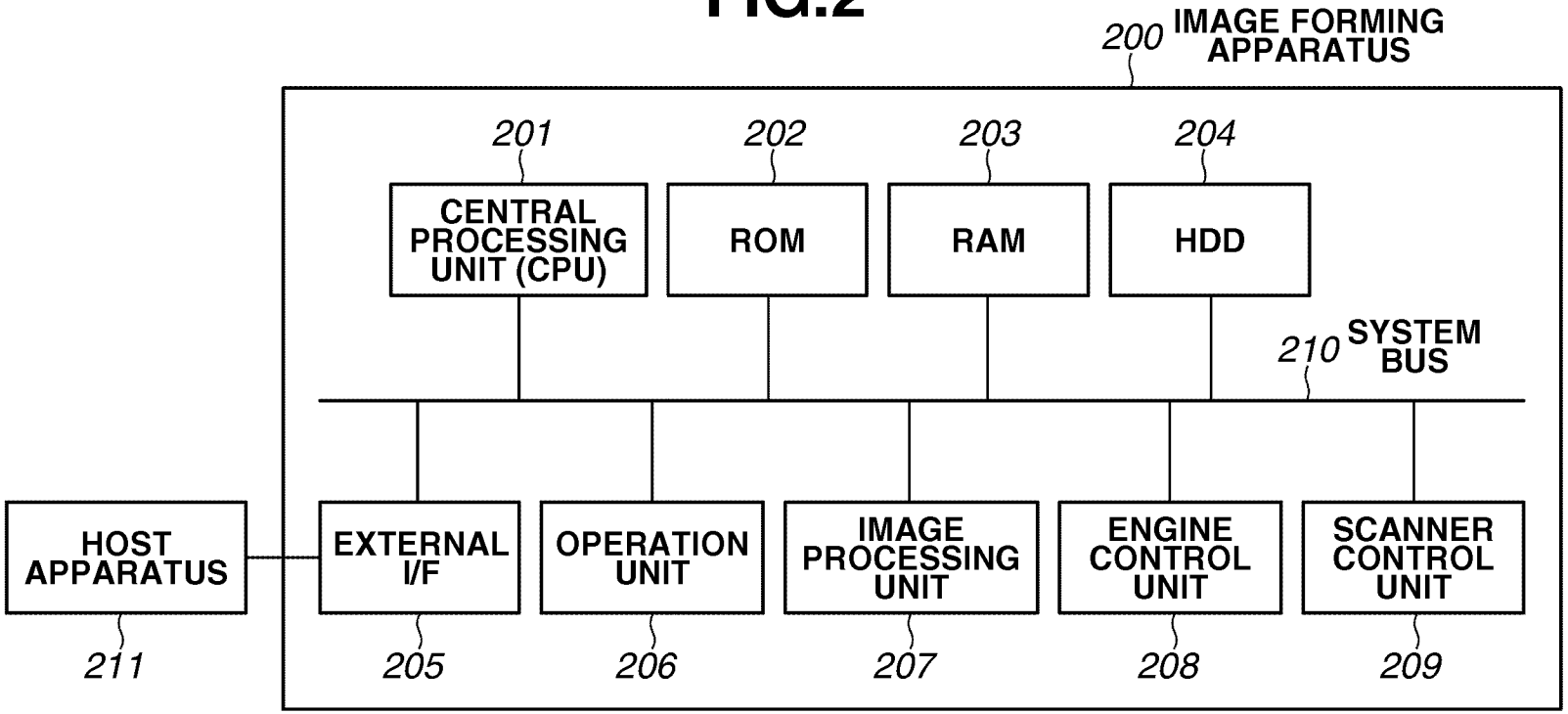
FIG. 2 is a block diagram illustrating an exemplary configuration related to control on the image forming apparatus illustrated in FIG. 1.

FIG. 2 is a block diagram illustrating an exemplary configuration related to control on the image forming apparatus illustrated in FIG. 1. Referring to FIG. 2, an image forming apparatus 200 is the image forming apparatus illustrated in FIG. 1. The configuration of the image forming apparatus 200 illustrated in FIG. 2 is a mere example. Accordingly, the image forming apparatus 200 according to an exemplary embodiment can be implemented by various modifications thereof.

The control unit 108 primarily includes a CPU 201, a read-only memory (ROM) 202, a random access memory (RAM) 203, an image processing unit 207, an engine control unit 208, and a scanner control unit 209. In addition, a hard disk drive (HDD) 204, an operation unit 206, and an external interface (I/F) 205 are connected to a control unit 108 via a system bus 210.

The CPU 201 functions as a central processor and includes a microprocessor (microcomputer). The CPU 201 is included in the control unit 108. The CPU 201 controls the operation of the entire image forming apparatus 200 by executing a program and by activating hardware.

The ROM 202 stores the program executed by the CPU 201 and fixed data necessary for executing various operations of the image forming apparatus 200. The RAM 203 is used as a work area for the CPU 201, a temporary storage area for temporarily storing various received data, and a storage area for storing various setting data.

The HDD 204 can store the program executed by the CPU 201, print data, and setting information necessary for executing various operations of the image forming apparatus 200 on a built-in hard disk. The stored program, print data, and setting information can be read from the built-in hard disk of the HDD 204. Another mass storage device can be used instead of the HDD 204.

The operation unit 206 includes hard keys and a touch panel, which can be operated by the user to execute various operations. In addition, the operation unit 206 includes a display unit for presenting the user with (i.e., notifying the user of) various information. The operation unit 206 is equivalent to the operation unit 115 illustrated in FIG. 1. The information can be presented to the user by outputting audio information (a buzz or voice) according to information generated by an audio information generation device (not illustrated).

The image processing unit 207 rasterizes (converts) print data (e.g., page description language (PDL) data) processed on the image forming apparatus 200 into image data (a bitmap image) and executes image processing on the rasterized image data. More specifically, the image processing unit 207 converts the color space (for example, YCbCr) of image data included in the input print data into the standard red (R), green (G), and blue (B) (RGB) color space, such as the sRGB color space.

In addition, the image processing unit 207 executes various image processing on the image data where necessary. The image processing executed by the image processing unit 207 on the input image data includes resolution conversion into effective number of pixels, image analysis, and image correction. The image data generated by the above-described image processing is stored on the RAM 203 or the HDD 204.

According to a control command received from the CPU 201, the engine control unit 208 controls processing for printing the image generated based on the input print data onto the sheet. In addition, the engine control unit 208 inputs an ink discharge instruction to the printing head 106 corresponding to each color. Furthermore, the engine control unit 208 sets the ink discharge timing to adjust the location of dots (the ink impact position) on the recording medium. Moreover, the engine control unit 208 adjusts the position of the printing head 106 according to acquired information about the status of driving the printing head.

In addition, the engine control unit 208 controls the driving of the printing head. Furthermore, the engine control unit 208 controls the printing head to discharge the ink to form an image on the sheet. Moreover, the engine control unit 208 gives an instruction for driving a sheet feed roller used for feeding the sheet from the cassette. In addition, the engine control unit 208 executes various control operations of a conveyance roller used for conveying the fed sheet, such as giving an instruction for driving the conveyance roller and acquiring the status of rotation of the conveyance roller. The engine control unit 208 further executes control for conveying the sheet at an appropriate speed in an appropriate sheet conveyance path and for stopping the sheet at an appropriate location on the sheet conveyance path.

According to a control command received from the CPU 201, the scanner control unit 209 controls an image sensor. More specifically, the scanner control unit 209 executes control for reading an image on the sheet to acquire analog (RGB) luminance data and converts the acquired analog data into digital data. A charge-coupled device (CCD) image sensor or a complementary metal oxide semiconductor (CMOS) image sensor can be used as the image sensor. Furthermore, a linear image sensor or an area image sensor can be used as the image sensor.

In addition, the scanner control unit 209 gives an instruction for driving the image sensor and acquires the status information about the image sensor driven according to the image sensor driving instruction. Furthermore, the scanner control unit 209 analyzes luminance data acquired from the image sensor to detect ink non-discharge from the printing head 106, if any, and detect an appropriate sheet cutting position. If it is determined by the scanner control unit 209 that the image has been normally printed, the sheet is subjected to drying processing for drying the ink applied onto the sheet before being discharged onto the designated tray included in the sorting unit 114.

A host apparatus 211 implements the above-described external apparatus. The host apparatus 211 is externally connected to the image forming apparatus 200 and functions as an apparatus for supplying image data to the image forming apparatus 200, which is to be printed by the image forming apparatus 200. Furthermore, the host apparatus 211 gives an order for executing various print jobs.

The host apparatus 211 can be implemented by a general-purpose personal computer (PC) or by a different type data supply apparatus. The different type data supply apparatus includes an image capturing apparatus configured to capture an image and generate image data based on the captured image. The image capturing apparatus includes a reader (scanner) that reads an image of a document and generates image data based on the read document image. Furthermore, the image capturing apparatus also includes a film scanner that reads a negative or a positive film and generates image data based on the image read from the film.

In addition, a digital camera that captures a still image and generates digital image data can implement the image capturing apparatus as another example thereof. Furthermore, a digital video camera that captures a moving image and generates moving image data based on the captured moving image can also implement the image capturing apparatus as a yet another example of the image capturing apparatus.

Moreover, a photo storage can be provided on a network or a removable portable memory reading interface having a socket-like shape can be provided to the image forming apparatus 200. In this case, an image file stored on the photo storage or on a portable memory device can be read therefrom to generate image data based on the read image and print the generated image data.

In addition, instead of the general-purpose PC, the host apparatus 211 can be implemented by a terminal dedicated for use as the host apparatus 211. In other words, various types of data supply apparatuses can implement the host apparatus 211. The above-described various types of data supply apparatuses can be included in the image forming apparatus or can be separately provided and externally connected to the image forming apparatus.

If a PC is used as the host apparatus 211, an operating system (OS), application software for generating image data, and a printer driver for the image forming apparatus 200 are installed on a storage device included in the PC. The printer driver controls the image forming apparatus 200 and converts image data supplied from the application software into image data having a format with which the image forming apparatus 200 can interpret the image data to generate print data based on the image data. Alternatively, the host apparatus 211 can convert the print data into image data and supply the converted image data to the image forming apparatus 200.

In the present exemplary embodiment, it is not required to implement all of the above-described processing by software. In other words, a part of or the entire processing can be implemented by hardware, such as application specific integrated circuit (ASIC).

Image data, various other commands, and status signals supplied from the host apparatus 211 can be transmitted to the image forming apparatus 200 via the external I/F 205. The external I/F 205 can be a local I/F or a network I/F. In addition, the connection via the external I/F 205 can be either wired or wireless. The above-described components of the image forming apparatus 200 are mutually connected and in communication with one another via the system bus 210.

As described above, one CPU 201 controls the operations of all the components of the image forming apparatus 200 illustrated in FIG. 2. However, the present invention is not limited to this. More specifically, some of the above-described functional blocks can include a separate CPU. In this case, each CPU can execute unique control.

In addition, the above-described functional blocks can employ various functional configurations different from the configuration illustrated in FIG. 2 to execute differently shared functions. More specifically, each functional block described above can be divided into separate processing units or control units. Furthermore, some of the above-described functional blocks can be implemented integrally as one unit. Moreover, the data can be read from the memory by using a direct memory access controller (DMAC).

Figure 3:
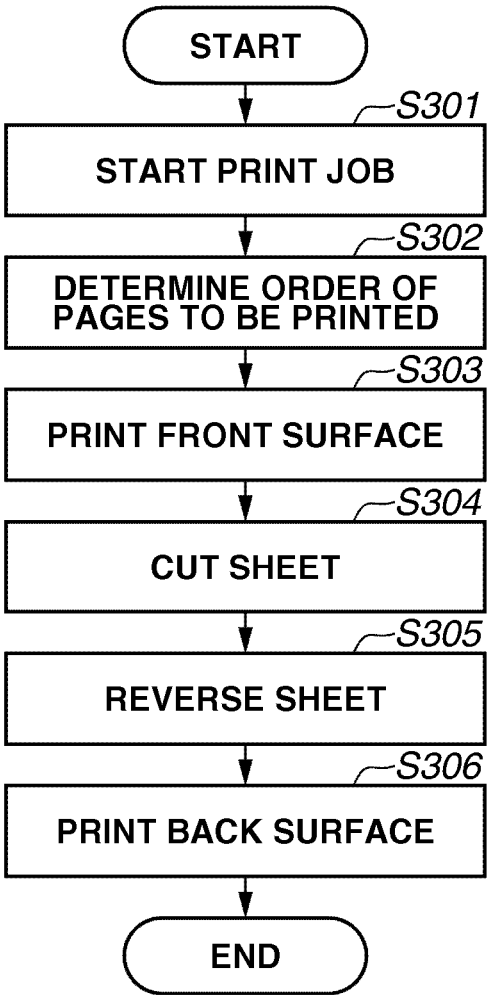
FIG. 3 is a flow chart illustrating an exemplary flow of two-sided printing according to an exemplary embodiment.

Now, exemplary processing performed by the image forming apparatus 200 having the above-described configuration to execute a print job will be described in detail below. FIG. 3 is a flow chart illustrating an exemplary flow of processing performed by the image forming apparatus 200 in executing a two-sided print job input thereto.

Processing according to the flow chart of FIG. 3 can be implemented by the CPU 201 by loading and executing a control program from the ROM 202 or the HDD 204 on the RAM 203. In an exemplary embodiment, it is supposed that the user has previously executed an operation via the operation unit 206 to register, to the RAM 203, the size (the roll sheet width) and a type (plain paper, glossy paper, or film) of the sheet that has been set in each of the upper-stage sheet cassette 101*a* and the lower-stage sheet cassette 101*b*.

Referring to FIG. 3, when a print job is received via the external I/F 205, processing of the print job starts in step S301. The received print job is temporarily stored on the HDD 204. In step S302, the CPU 201 determines the order of printing pages included in the received print job.

In step S302, the CPU 201 determines the order of printing the pages to execute the print job in the following manner. More specifically, the CPU 201 performs control for serially executing printing of a plurality of pages on the first surface (e.g., the front surface) of the sheet before serially executing printing of the plurality of pages on the opposite surface.

The serial printing of the plurality of pages on the same surface of the sheet can be executed if the printing is executed by using the sheets having the same sheet size and the same sheet type. However, it is not always necessary that the sheets of the same sheet size are used. More specifically, if printing on a sheet of a size larger than the size of the sheet to be output, which has been designated in the print job, has been previously permitted, the sheets of mutually different sizes can be used. Furthermore, if the sheet type is not to be particularly used as a basis of determining the printing order, sheets of mutually different types can be used.

However, the printing order can be determined by a method different from the above-described method. In other words, whether to serially perform printing of the plurality of pages of the print job can be determined according to a printing mode (i.e., one-sided printing, two-sided printing, and book binding processing). To paraphrase this, the printing according to an exemplary embodiment can be implemented if images of a plurality of pages, which can be printed on the same sheet, can be serially printed.

The serial printing of the plurality of pages on the same surface can be executed during processing of one print job only. However, the present invention is not limited to this. More specifically, the serial printing of the plurality of pages on the same surface can be executed during processing of a plurality of print jobs.

The printing order of printing on a second (the opposite) surface is reversed from that of printing on the first surface. In other words, if the printing on the first surface is executed in ascending order, the printing on the second surface is executed in descending order. This is because in executing printing on the second surface, the sheet is cut after the last printing on the first surface is executed and the cut sheet is conveyed with an edge of the sheet on which the sheet has been cut (i.e., the opposite surface of the sheet having the image of the page printed the last) now having become a leading edge of the sheet to be conveyed for the printing on the second sheet.

In step S303, the CPU 201 starts the printing on the first surface (i.e., the front surface) of the sheet according to the page order determined in step S302. More specifically, the CPU 201 supplies the image processing unit 207 with print data of each page according to the printing order determined in the above-described manner.

The image processing unit 207 converts the print data supplied from the image processing unit 207 into a format with which the print data to be printed on the front surface can be printed (i.e., executes rasterization into image data) and then stores the converted image data on the HDD 204. Furthermore, the image processing unit 207 supplies the generated image data to the engine control unit 208 in the above-described page order.

Furthermore, in step S303, the image processing unit 207 notifies the engine control unit 208 of information about on which surface of the sheet the image data is to be printed, to which page the image data corresponds, and information for uniquely identifying the print job together with the image data.

After receiving the image data, the engine control unit 208 executes control for feeding the sheet from the upper-stage sheet cassette 101*a* or the lower-stage sheet cassette 101*b*. The cassette from which the sheet is to be fed is determined according to the size of the image to be printed and the type of the sheet used in the printing.

In addition, the engine control unit 208 controls the conveyance unit 102 to convey the sheet to a printing position at which the head unit 105 prints the image to serially print the images on the front surface of the sheet. Then, the sheet is conveyed to a reading position, at which the scanner unit 107 reads the printed image.

The CPU 201 verifies whether the image has been normally printed by reading the printed image by using the scanner unit 107 according to a content of the image data acquired by reading the printed image. Then, the sheet is conveyed towards the cutter unit 110.

If it is determined that the image has been normally printed, the CPU 201 executes control for not cutting the sheet by using the cutter unit 110 in units of pages at this timing. Then, in this case, the sheet is conveyed into the drying unit 112 in a state in which sheets having the images corresponding to the plurality of pages are yet to be cut in units of pages. Then, the drying unit 112 executes processing for drying the ink applied on the sheet and the sheet is wound up by the sheet winding unit 113.

Because two-sided printing is currently executed, the sheet is wound up by the sheet winding unit 113 without cutting the same into a plurality of sheets. If one-sided printing is executed, the sheet is cut in units of pages (note that the sheet may not be cut in some cases) (i.e., the sheet is not wound up by the sheet winding unit 113).

On the other hand, if it is determined that the image has not been normally printed, the CPU 201 controls the cutter unit 110 to cut the sheet to discharge the sheet having the image of the page that has not been normally printed. The CPU 201 further executes control for discharging the cut sheet having the failed page image selectively onto a tray for stacking poorly printed sheets selected from among the trays of the sorting unit 114 (i.e., onto a lowermost tray).

In this case, in order to normally print the page that has not been normally printed yet by executing printing thereof again, the CPU 201 supplies the image data to the engine control unit 208 and performs control for executing the subsequent processing again. After completing the printing of the serial printing on the front surface, the processing advances to step S304. In step S304, the cutter unit 110 cuts the sheet having the image printed on the front surface thereof.

In step S305, the sheet having the image printed on the front surface thereof and having been wound up by the sheet winding unit 113 is conveyed again into the conveyance unit 102 with the surface of the sheet opposite to the first surface thereof facing the head unit 105. The printing on the back surface can be executed in the same manner as the printing on the front surface. Accordingly, the printing on the back surface will not be described in detail below. However, after the printing on the back surface is completed, the cutter unit 110 cuts the sheet in units of pages (in the case of bookbinding processing, the sheet can be cut in the unit of two pages). The cut sheets are to be discharged onto the tray of the sorting unit 114.

If it has been previously designated in the print job not to cut the sheet at this timing, the cutter unit 110 does not cut the sheet at this timing. As described above, an embodiment executes the two-sided printing if no cause for suspending the printing does not arise during the printing.

On the other hand, if a one-sided print job has been input, the present embodiment executes the printing in the following manner. More specifically, after completing the printing on the first surface of the sheet, the cutter unit 110 serially cuts the sheet having the printed image in units of pages. The cut sheets are serially discharged onto the tray of the sorting unit 114.

Figure 4:
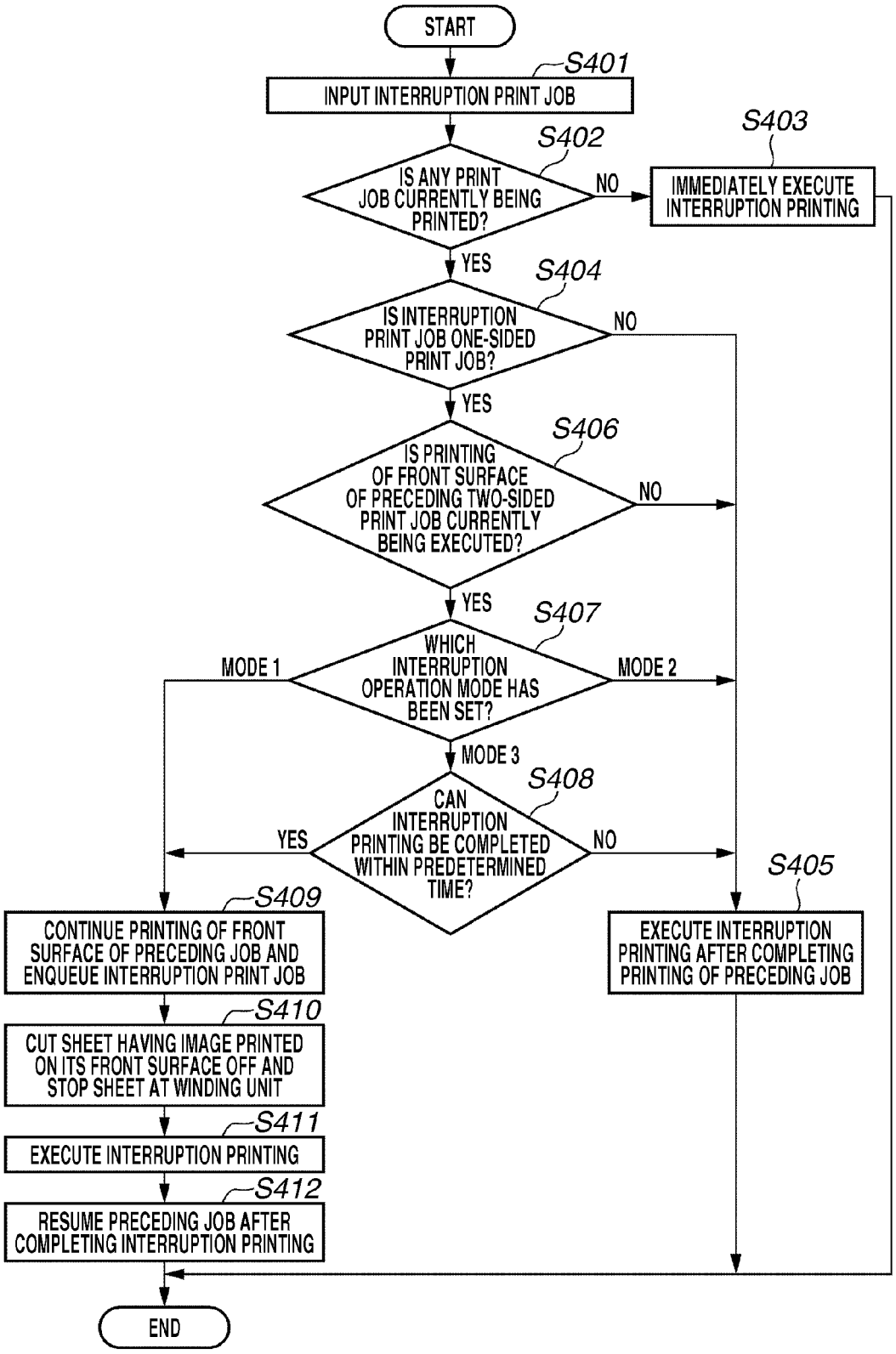
FIG. 4 is a flow chart illustrating an exemplary flow of interruption printing according to an exemplary embodiment.

Processing executed if an interruption print job is input after the above-described two-sided print job has been input will be described in detail below with reference to FIG. 4. FIG. 4 is a flow chart illustrating an exemplary flow of interruption printing according to an exemplary embodiment. Processing according to the flow chart of FIG. 4 can be implemented by the CPU 201 by loading and executing a control program from the ROM 202 or the HDD 204 on the RAM 203.

Referring to FIG. 4, in step S401, the user inputs an instruction for executing an interruption print job (i.e., an instruction for moving the printing order of the interruption print job up as a result). In the present embodiment, it is supposed that a print job including information indicating that the newly input print job is to be urgently and immediately executed has been input by the host apparatus 211 as an interruption print job. However, the interruption print job according to the present invention is not limited to this. More specifically, the interruption print job can also include a print job, of print jobs that have already been input to the image forming apparatus 200 during a specific currently executed print job, which has been selected via the host apparatus 211 or the operation unit 206 and which has been instructed to be urgently executed.

In addition, if a print job exists whose priority order is lower than the priority order of the job about to be executed, based on the priority order designated for each print job or the priority order designated by the user who has input the print job about to be executed, the newly input can be executed before executing the low priority print job even if no urgent print job has been input during the current printing. Furthermore, if the user directly designates the print job input during the current print job to be an "interruption print job", the interruption print job designated by the user can be executed in priority to the normal print job (i.e., the print job that has not been designated as an interruption print job).

In step S402, the CPU 201 determines whether any currently printed preceding job exists. If any print job that has been input to the image forming apparatus 200 before the interruption print job is input is not currently enqueued (i.e., waiting to be printed), the CPU 201 determines that no currently printed preceding job exists. Furthermore, if the printing in one unit of printing has been completed, if next printing in one unit of printing is ready, and if the image forming apparatus 200 is not currently executing printing, then the CPU 201 determines that no currently printed preceding job exists.

If it is determined that no currently printed preceding job exists (NO in step S402), then the processing advances to step S403. In step S403, the CPU 201 executes control for performing the printing of the print job input in step S401. On the other hand, if it is determined that any currently printed preceding job exists (YES in step S402), then the processing advances to step S404.

In step S404, the CPU 201 determines whether the input interruption print job is a one-sided print job. If it is determined that the input interruption print job is not a one-sided print job (NO in step S404), then the processing advances to step S405. In step S405, the CPU 201 executes printing of the interruption print job after the printing of the currently printed preceding job is completed. In this case, the printing of the interruption print job is executed in priority to a subsequent print job, if any. On the other hand, if it is determined that the input interruption print job is a one-sided print job (YES in step S404), then the processing advances to step S406.

In step S406, the CPU 201 determines whether the printing of the front surface of the preceding two-sided print job determined to have been currently printed in step S402 is currently executed. If the printing on the back surface of the sheet has already been started, it is determined that the printing of the front surface of the preceding two-sided print job determined to have been currently printed in step S402 is not currently executed (NO in step S406). Then, the processing advances to step S405.

On the other hand, if the printing on the front surface is currently executed or if the printing on the front surface has been completed but the sheet is currently wound up by the sheet winding unit 113 (before the printing on the back surface is started) (YES in step S406), then the processing advances to step S407. In other words, if it is determined that the printing on the back (second) surface of the sheet has not been started yet in the preceding two-sided print job (YES in step S406), then the processing advances to step S407.

In step S407, the CPU 201 determines an interruption operation mode. The interruption operation mode can be designated by the user via the host apparatus 211 or the operation unit 206 when the user inputs the interruption print job in step S401. Alternatively, the interruption operation mode can be previously registered to the image forming apparatus 200 (on the HDD 204 or the like). Further alternatively, the interruption operation mode can be determined according to an urgency level, which can be set when the instruction for executing the interruption print job.

If it is determined that the designated interruption operation mode is "mode 1" in step S407, then the processing advances to step S409. On the other hand, if it is determined that the designated interruption operation mode is "mode 2" in step S407, the processing advances to step S405. If "mode 3" has been designated as the interruption operation mode, the processing advances to step S408.

The interruption operation mode is not limited to the above-described three modes. In other words, any appropriate mode different from the three modes can be used. Furthermore, it is not required to use all the three modes. Alternatively, the image forming apparatus 200 can execute an operation according to any specific mode only. In this case, the image forming apparatus 200 cannot select the mode itself.

In step S408, the CPU 201 determines whether the interruption print job input in step S401 can be completed within a predetermined time. The time for completing the interruption print job is estimated based on information, such as the length of the sheet used in the interruption print job, the number of pages printed by the interruption print job, the amount of data printed by the print job, the content of the print job (estimated time for image processing), and the time required for winding up the sheet used in the preceding job (the processing in steps S409 and S410).

To paraphrase this, the determination in step S408 is executed based on whether the time required for processing the interruption print job estimated in the above-described manner is equal to or shorter than proxy response data time. A method for executing the above-described determination is not limited to a specific method. In other words, the above-described determination can be executed based on various appropriate conditions.

If it is determined that the interruption print job cannot be completed within the predetermined time (NO in step S408), then the processing advances to step S405. On the other hand, if it is determined that the interruption print job can be completed within the predetermined time (YES in step S408), then the processing advances to step S409.

However, alternatively, if it is determined, by comparing the priority of the interruption print job and the preceding job, that the interruption print job has a higher priority, the processing can advance to step S409 while if it is determined, as a result of the comparison, that the preceding job has a higher priority, then the processing can advance to step S405.

In step S409, the CPU 201 executes control for continuing the printing of the preceding job on the front surface of the sheet. While the printing of the preceding job on the front surface of the sheet is continued, the interruption print job is temporarily stored on the HDD 204 to be enqueued for printing. In this case, printing of all the pages to be printed on the front surface of one print job is continued. However, the present invention is not limited to this.

More specifically, instead of the above-described configuration, printing of all the pages to be printed on the front surface of a plurality of print jobs that have been determined, in step S302, to be serially printed on the front surface of the sheet can be executed.

If it is determined that the printing on the front surface has already been completed (NO in step S406), then in step S409, the CPU 201 merely causes the interruption print job to be enqueued for printing.

In step S410, after completing the printing of the front surface of the preceding job, the cutter unit 110 cuts the sheet. Then, the sheet is wound up by the sheet winding unit 113. The sheet is stopped (i.e., the preceding job is suspended) at the sheet winding unit 113 in the wound-up state to wait for the printing thereon to be resumed. In this case, the sheet may not be cut if all the sheets set in the cassette are to be used. This is because the winding of the sheet by the sheet winding unit 113 can be completed if the sheet is separated from the upper-stage sheet cassette 101*a* or the lower-stage sheet cassette 101*b*.

In step S411, the CPU 201 executes the interruption printing of the interruption print job input in step S401. If the sheet used in the interruption print job is different from the sheet used in the preceding job, the CPU 201 changes the sheet feeding source cassette. On the other hand, if the sheet used in the interruption print job is the same as the sheet used in the preceding job, the CPU 201 does not change the sheet feeding source cassette and executes control for feeding the sheet from the same cassette.

After the printing of the interruption print job in step S411 is completed, the processing advances to step S412. In step S412, the CPU 201 resumes the printing of the suspended preceding job. More specifically, the CPU 201 executes control for conveying the sheet that has been stopped at the sheet winding unit 113 to the printing head 106 with the back surface (the second surface) thereof facing the printing head 106 to print the image on the opposite surface of the already printed front surface. In printing on the back surface, the cutter unit 110 cuts the sheet in units of pages.

In steps S403, S405, and S411, the sheet printed by the interruption print job is discharged on a tray different from the tray used in the printing of the preceding job to discharge the sheet printed by the preceding job thereon. Accordingly, an adverse mixture of the sheets printed by the preceding job and the interruption print job can be effectively prevented.

More specifically, a specific tray of the trays of the sorting unit 114 can be used to discharge the sheet for the interruption print job thereon. For example, the uppermost large tray can be used as the discharge tray for the interruption print job.

With the above-described configuration, in executing printing that uses a continuous sheet, an exemplary embodiment can securely input and execute a subsequent job without wastefully discarding the printed sheets of the preceding job whose printing has been already started when the subsequent job is input.

In the above-described example, if it is determined that the printing of the back surface of the preceding job has been already been started in step S406, the interruption print job is executed after completing the preceding job. However, the interruption print job can be executed before completing the preceding job in this case.

In other words, if the printing of the back surface of the preceding job is currently executed when an instruction for executing the interruption print job is input in step S401, the sheet for the preceding job can be stopped by reversely rotating the sheet winding unit 113 at a timing of cutting the sheet after completing the printing of the back surface of the sheet up to the stage at which the printing of the back surface of the preceding job can be stopped. Therefore, in this case, the interruption print job can be executed in this state. After the interruption print job is completed, the remaining portion of the printing of the back surface of the preceding job can be executed.

Accordingly, the interruption printing can be completed within a short time period even if the printing of the preceding job on the back surface of the sheet has already been started. In this case, the sheet discharged after printing the print job can be discharged on the same tray for the preceding job across the timing of inputting the interruption print job. Alternatively, the sheet can be discharged on to a tray other than the tray used before the interruption print job is input or a tray other than the tray for the interruption print job.

If the former configuration is employed, the user may not be required to rearrange the sheets across the timing of input of the interruption print job. On the other hand, if the latter is employed, the sheets printed before the interruption print job is executed and those printed after the input of the interruption print job can be easily separated from one another.

In addition, in the above-described example, in step S409, the printing of the preceding job on the front surface of the sheet is completed for the number of pages that have been determined to be continuously printed. However, the interruption print job can be started before completing the printing.

More specifically, if the printing of the front surface of the preceding job is currently executed when the instruction for executing the interruption print job is input in step S401, the printing of the front surface of the preceding job is suspended at a timing at which the printing of the front surface of the preceding job is completed at the stage at which the printing of the front surface of the preceding job can be stopped. Therefore, in this case, the cutter unit 110 cuts the sheet in this state. Then, the cut sheets are wound up by the sheet winding unit 113 to be stopped there. Then, the interruption print job is executed. Then, the printing of the enqueued preceding job is resumed.

In resuming the preceding job, it becomes necessary to change the printing order. To paraphrase this, in resuming the preceding job, because the printing on the front surface has been already completed to some degree (but not entirely completed), it becomes necessary to execute printing on the opposite surface.

Accordingly, the CPU 201 executes control for identifying how many pages of the preceding job to be printed on the front surface have been already printed. In this case, the CPU 201 executes control for printing the opposite surface of the sheets whose printing of the front surface has been already executed. Subsequently, the remaining pages to be printed on the front surface are printed. Then, the printing of the opposite surfaces corresponding to the once remaining front pages is executed. The printing order is changed to execute the printing in the above-described order.

In this case, the sheet discharged after printing the preceding print job can be discharged on the same tray for the preceding job across the timing of inputting the interruption print job. Alternatively, the sheet can be discharged onto a tray other than the tray used before the interruption print job is input or a tray other than the tray for the interruption print job. As described above, the interruption print job can be completed in a short period of time.

Moreover, in the above-described example, when two-sided printing is executed, the sheet whose printing on the first surface has been completed is wound up by the sheet winding unit 113. However, the sheet can be stopped without winding it up in a roll-like shape. More specifically, in this case, a sheet reversal mechanism can be used, which is capable of stopping the sheet after serially executing printing on the first surface thereof (by holding the sheet at a specific position within the printing unit) and also capable of executing the printing on the second surface after the sheet is reversed. In other words, various methods different from that described above can be used to stop and reverse the sheet.

In the above-described example, it is supposed that the preceding job is a two-sided print job. However, if the preceding job is a one-sided print job, the CPU 201 can execute control for suspending the preceding job and executing the input interruption print job before resuming the suspended preceding job. Furthermore, according to the priority order or the mode of each job, the CPU 201 can execute control for executing the interruption print job after completing one-sided printing of the preceding job.

Furthermore, the above-described exemplary embodiment can also be implemented by the following configuration. More specifically, an external apparatus, such as a host apparatus or an external controller, can implement scheduling (the determination) of the printing order and the determination as to whether an interruption print job can be input excluding the print processing itself. In this case, the image forming apparatus can execute the printing according to the printing order or the availability of printing of the interruption print job determined by the external apparatus.

In this case, the external apparatus can determine the printing order or the timing of inputting the interruption print job based on status information (information including the status of progress of the current printing) about the image forming apparatus. The external apparatus can function as the printing control apparatus of the present embodiment in this case.

As described above, according to the exemplary embodiment, if an instruction for executing an interruption print job is input when a preceding job is currently executed, the CPU 201 executes control for holding the continuous sheet used in the preceding two-sided print job at a reversal unit and for suspending the preceding two-sided print job in this state. Accordingly, the exemplary embodiment having the above-described configuration can execute interruption printing while currently executing the printing of the preceding two-sided print job on the continuous sheet and can appropriately complete the preceding two-sided print job.

An embodiment can also be achieved by providing a system or an apparatus with a storage medium storing program code of software implementing the functions of the embodiments and by reading and executing the program code stored in the storage medium with a computer of the system or the apparatus (a CPU or an MPU). In an example, a computer-readable medium may store a program that causes a printing control apparatus to perform a method described herein. In another example, a central processing unit (CPU) may be configured to control at least one unit utilized in a method or apparatus described herein.

In this case, the program can be executed on one computer or on a plurality of computers operating in interlock with one another. In addition, it is not required to implement all the above-described processing by software. In other words, a part of or the entire processing described above can also be implemented by hardware.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-068288 filed Mar. 24, 2010, which is hereby incorporated by reference herein in its entirety.

What is claimed is:

1. A printing control apparatus to control printing on a continuous sheet by using a printing unit, the printing control apparatus comprising:

an input unit configured to input, while printing of a first print job on a first continuous sheet is executed, a print job having a higher priority than a priority of the first print job;

a reversal control unit configured to cause a sheet reversing unit to reverse the continuous sheet to execute printing on a second surface of the continuous sheet after executing printing on a first surface of the continuous sheet;

a printing control unit configured to cause the printing unit to execute printing of a print job on the continuous sheet, and a cutting control unit configured to cause a cutting unit to cut the continuous sheet, wherein, in a case where the input unit inputs the print job having a higher priority while printing of the first print job on the first continuous sheet is executed, the cutting control unit is configured to cause the cutting unit to cut the first continuous sheet and the printing control unit is configured to execute control to suspend printing of the first print job on the first continuous sheet in a state where the cut first continuous sheet is held at the sheet reversing unit, to cause the printing unit to execute printing of the print job having a higher priority on a second continuous sheet and, after printing of the print job having a higher priority is completed, to release the cut first continuous sheet from the sheet reversing unit and resume processing of the first print job on the cut first continuous sheet, wherein the reversal control unit is configured to cause the sheet reversing unit to wind up the first continuous sheet into a wound-up continuous sheet, printing on the first surface of which has been effected, by a rotational operation and to supply the wound-up continuous sheet to the printing unit in a state where the first surface and the second surface of the continuous sheet have been reversed to execute printing on the second surface, and wherein, in a case where the input unit inputs the print job having a higher priority while printing of the first print job on the second surface of the first continuous sheet is executed, the printing control unit is configured to execute control to suspend printing of the first print job on the second surface of the first continuous sheet in a state where the first continuous sheet is held at the sheet reversing unit by reversely rotating the sheet reversing unit and to cause the printing unit to execute printing of the print job having a higher priority on the second continuous sheet.

2. The printing control apparatus according to claim 1, wherein, before the printing control unit executes control to suspend printing of the first print job on the first continuous sheet, the printing control unit executes control to complete printing of a remainder of a plurality of pages of the first print job on a first surface of the first continuous sheet so that printing on the first surface has been effected, and then to cause the printing unit to execute printing of the print job having a higher priority on the second continuous sheet.

3. The printing control apparatus according to claim 1, wherein, in a case where the input unit inputs the print job having a higher priority while printing of the first print job is executed, the printing control unit is further configured to determine, according to a content of the print job having a higher priority, whether to suspend processing of the first print job and then execute printing of the input print job having a higher priority or to complete the first print job and then execute printing of the print job having a higher priority after completing the first print job.

4. A method for controlling a printing control apparatus to control printing on a continuous sheet by using a printing unit and using a reversal control unit configured to cause a sheet reversing unit to reverse the continuous sheet to execute printing on a second surface of the continuous sheet after executing printing on a first surface of the continuous sheet, the method comprising:

inputting, via an input unit and while causing the printing unit to execute printing of a first print job on a first continuous sheet, a print job having a higher priority than a priority of the first print job;

causing, via a printing control unit, the printing unit to execute printing of a print job on the continuous sheet; and causing a cutting unit to cut the continuous sheet, wherein, in a case where the print job having a higher priority is input while causing the printing unit to execute printing of the first print job on the first continuous sheet, the cutting unit is caused to cut the first continuous sheet and the printing control unit is caused to execute control to suspend printing of the first print job on the first continuous sheet in a state where the cut first continuous sheet is held at the sheet reversing unit, to cause the printing unit to execute printing of the print job having a higher priority on a second continuous sheet and, after printing of the print job having a higher priority is completed, to release the cut first continuous sheet from the sheet reversing unit and resume processing of the first print job on the cut first continuous sheet, wherein the reversal control unit is configured to cause the sheet reversing unit to wind up the first continuous sheet into a wound-up continuous sheet, printing on the first surface of which has been effected, by a rotational operation and to supply the wound-up continuous sheet to the printing unit in a state where the first surface and the second surface of the continuous sheet have been reversed to execute printing on the second surface, and wherein, in a case where the input unit inputs the print job having a higher priority while printing of the first print job on the second surface of the first continuous sheet is executed, the printing control unit is configured to execute control to suspend printing of the first print job on the second surface of the first continuous sheet in a state where the first continuous sheet is held at the sheet reversing unit by reversely rotating the sheet reversing unit and to cause the printing unit to execute printing of the print job having a higher priority on the second continuous sheet.

5. A non-transitory computer-readable storage medium storing a program which, when executed by a printing control apparatus to control printing on a continuous sheet by using a printing unit and using a reversal control unit configured to cause a sheet reversing unit to reverse the continuous sheet to execute printing on a second surface of the continuous sheet after executing printing on a first surface of the continuous sheet, causes the printing control apparatus to perform a method, the method comprising:

inputting, via an input unit and while causing the printing unit to execute printing of a first print job on a first continuous sheet, a print job having a higher priority than a priority of the first print job;

causing, via a printing control unit, the printing unit to execute printing of a print job on the continuous sheet; and causing a cutting unit to cut the continuous sheet, wherein, in a case where the print job having a higher priority is input while causing the printing unit to execute printing of the first print job on the first continuous sheet, the cutting unit is caused to cut the first continuous sheet and the printing control unit is caused to execute control to suspend printing of the first print job on the first continuous sheet in a state where the cut first continuous sheet is held at the sheet reversing unit, to cause the printing unit to execute printing of the print job having a higher priority on a second continuous sheet and, after printing of the print job having a higher priority is completed, to release the cut first continuous sheet from the sheet reversing unit and resume processing of the first print job on the cut first continuous sheet, wherein the reversal control unit is configured to cause the sheet reversing unit to wind up the first continuous sheet into a wound-up continuous sheet, printing on the first surface of which has been effected, by a rotational operation and to supply the wound-up continuous sheet to the printing unit in a state where the first surface and the second surface of the continuous sheet have been reversed to execute printing on the second surface, and wherein, in a case where the input unit inputs the print job having a higher priority while printing of the first print job on the second surface of the first continuous sheet is executed, the printing control unit is configured to execute control to suspend printing of the first print job on the second surface of the first continuous sheet in a state where the first continuous sheet is held at the sheet reversing unit by reversely rotating the sheet reversing unit and to cause the printing unit to execute printing of the print job having a higher priority on the second continuous sheet.

6. The printing control apparatus according to claim 1, further comprising:

a determination unit configured to determine an operation mode among a plurality of operation modes, for the print job having a higher priority, wherein, in a case where the input unit inputs the print job having a higher priority while printing of the first print job on the first continuous sheet is executed, the printing control unit is further configured to execute control based on the operation mode, wherein the operation mode includes a first mode for executing printing of the print job having a higher priority before executing the printing of the first print job is completed and a second mode for executing printing of the print job having a higher priority after printing of the first print job is completed.

7. The printing control apparatus according to claim 6, wherein, the determination unit determines the operation mode for the print job having a higher priority based on designating by a user instruction, based on setting for the control apparatus, or based on an urgency level of the print job having a higher priority.

8. The printing control apparatus according to claim 1, wherein, in a case where the input unit inputs the print job having a higher priority while printing of the first print job on the first continuous sheet is executed and the printing control unit determines that the print job having a higher priority can be completed within a predetermined time, the printing control unit is configured to execute control to suspend printing of the first print job on the first continuous sheet in a state where the first continuous sheet is held at the sheet reversing unit after printing on the first surface of the first continuous sheet is completed, to cause the printing unit to execute printing of the print job having a higher priority on a second continuous sheet and, after printing of the print job having a higher priority is completed, to release the first continuous sheet from the sheet reversing unit and resume processing of the first print job on the first continuous sheet.

9. The printing control apparatus according to claim 8, wherein the printing control unit estimates a time for completing the print job having a higher priority based on at least one of a length of the continuous sheet used in the print job having a higher priority, a number of pages to be printed by the print job having a higher priority, an amount of data to be printed by the first print job, content of the first print job, and time required to wind up the continuous sheet used in a currently printed preceding job.

10. The printing control apparatus according to claim 8, wherein the printing control unit determines whether the print job having a higher priority can be completed within the predetermined time by determining whether an estimated time for completing the print job having a higher priority is equal to or shorter than proxy response data time.

11. The printing control apparatus according to claim 8, wherein, in response to the printing control unit determining that the print job having a higher priority cannot be completed within the predetermined time, the printing control unit executes printing of the print job having a higher priority after the printing of the first print job is completed on both surfaces of the first continuous sheet.

12. The printing control apparatus according to claim 1, wherein the first print job is a currently printed preceding job and, in response to the printing control unit determining that the printing of the first surface of the currently printed preceding job is currently executed, the printing control unit is configured to determine a priority of the first print job and the print job input by the input unit while printing of the first print job.

13. The printing control apparatus according to claim 1, wherein the first print job is a currently printed preceding job and wherein, in response to the printing control unit determining that the print job having a higher priority is not a one-sided print job, the printing control unit executes printing of the print job having a higher priority after the printing of the currently printed preceding job is completed.

14. The printing control apparatus according to claim 1, wherein the first print job is a currently printed preceding job and wherein, in response to the printing control unit determining that the printing of the first surface of the currently printed preceding job is not currently executed, then the printing control unit executes printing of the print job having a higher priority after the printing of the currently printed preceding job is completed.

15. The printing control apparatus according to claim 1, wherein the printing control unit includes a central processing unit and the continuous sheet is continuous recording material having a length that is longer than a unit of printing, which is a length of a page, in a conveyance direction of the continuous recording material, and, when processing of the two-sided print job on the continuous sheet is resumed, the continuous sheet has been converted into cut sheets.

16. The printing control apparatus according to claim 1, wherein, in a case where the printing control unit determines that the print job having a higher priority cannot be completed within the predetermined time, the printing control unit executes printing of the print job having a higher priority after the printing of the first print job is completed.

17. The printing control apparatus according to claim 1, wherein, in a case where the input unit inputs the print job having a higher priority while printing of the two-sided print job by the printing unit on the first surface of the continuous sheet has been currently executed, the cutting control unit is configured to cause the cutting unit to cut the first continuous sheet, printing on the first surface of which has been effected, and the printing control unit is configured to execute control to suspend printing of the first print job on the cut first continuous sheet in a state where the cut first continuous sheet is held at the sheet reversing unit, to cause the printing unit to execute printing of the print job having a higher priority on a second continuous sheet.

18. The printing control apparatus according to claim 1, wherein, in a case where a two-sided print job is executed by the printing unit on both surfaces of the continuous sheet, the cutting control unit is configured to cause the cutting unit to cut the continuous sheet in unit of printing after printing on the second surface of the continuous sheet.

* * * * *